US009062622B2

(12) United States Patent
Onoe et al.

(10) Patent No.: US 9,062,622 B2
(45) Date of Patent: Jun. 23, 2015

(54) AIR-FUEL RATIO CONTROL APPARATUS

(75) Inventors: Ryota Onoe, Susono (JP); Junichi Suzuki, Susono (JP); Takahiko Fujiwara, Susono (JP); Makoto Tomimatsu, Susono (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 318 days.

(21) Appl. No.: 13/821,795

(22) PCT Filed: Sep. 9, 2010

(86) PCT No.: PCT/JP2010/065492

§ 371 (c)(1),
(2), (4) Date: May 20, 2013

(87) PCT Pub. No.: WO2012/032631

PCT Pub. Date: Mar. 15, 2012

(65) Prior Publication Data

US 2013/0231845 A1 Sep. 5, 2013

(51) Int. Cl.

| | |
|---|---|
| ***F02D 41/02*** | (2006.01) |
| ***F02D 41/14*** | (2006.01) |
| ***F02D 41/24*** | (2006.01) |

(52) U.S. Cl.

CPC ..... *F02D 41/0235* (2013.01); *F02D 41/1441* (2013.01); *F02D 41/1475* (2013.01); *F02D 41/1454* (2013.01); *F02D 41/2441* (2013.01); *F02D 41/2454* (2013.01)

(58) Field of Classification Search

USPC ..... 701/103, 104, 109, 114; 123/672, 674, 123/703, 679, 690, 692, 693; 60/274

See application file for complete search history.

(56) References Cited

U.S. PATENT DOCUMENTS

| | | | | |
|---|---|---|---|---|
| 4,831,838 | A * | 5/1989 | Nagai et al. | 60/274 |
| 5,119,629 | A | 6/1992 | Kume et al. | |
| 5,974,793 | A * | 11/1999 | Kinugasa et al. | 60/285 |

(Continued)

FOREIGN PATENT DOCUMENTS

| | | |
|---|---|---|
| JP | 2 11841 | 1/1990 |
| JP | 6-317204 | 11/1994 |

(Continued)

OTHER PUBLICATIONS

International Search Report Issued Oct. 19, 2010 in PCT/JP10/65492 Filed Sep. 9, 2010.

*Primary Examiner* — Stephen K Cronin
*Assistant Examiner* — Joshua A Campbell
(74) *Attorney, Agent, or Firm* — Oblon, McClelland, Maier & Neustadt, L.L.P.

(57) ABSTRACT

An air-fuel ratio control apparatus of the present invention comprises an inverse direction spike introducing section and an inverse direction spike interval setting section. The inverse direction spike introducing section introduces, while an air-fuel ratio correction required by an output of a downstream air-fuel ratio sensor is being carried out, an inverse direction spike which is an air-fuel ratio spike to temporarily change an air-fuel ratio of an exhaust gas toward a direction opposite to a direction of the air-fuel ratio correction with respect to a target control air-fuel ratio. The inverse direction spike interval setting section sets, based on an operating state of an internal combustion engine system, an inverse direction spike interval which is an interval between two of the inverse direction spikes next to each other in time.

18 Claims, 9 Drawing Sheets

(56) References Cited

U.S. PATENT DOCUMENTS

| | | | | |
|---|---|---|---|---|
| 6,003,308 | A * | 12/1999 | Tsutsumi et al. | 60/276 |
| 2002/0011068 | A1* | 1/2002 | Kako et al. | 60/285 |
| 2008/0072884 | A1* | 3/2008 | Okazaki | 123/703 |
| 2013/0231845 | A1* | 9/2013 | Onoe et al. | 701/104 |

FOREIGN PATENT DOCUMENTS

| | | | |
|---|---|---|---|
| JP | 8-189399 | | 7/1996 |
| JP | 10 131790 | | 5/1998 |
| JP | 2001-152913 | | 6/2001 |
| JP | 2003-314334 | | 11/2003 |
| JP | 2004-183585 | | 7/2004 |
| JP | 2005-76496 | | 3/2005 |
| JP | 2005-120869 | | 5/2005 |
| JP | 2005-273524 | | 10/2005 |
| JP | 2007-56755 | | 3/2007 |
| JP | 2007 87411 | | 4/2007 |
| JP | 2007087411 | A * | 4/2007 |
| JP | 2007-239698 | | 9/2007 |
| JP | 2007 247574 | | 9/2007 |
| JP | 2009-2170 | | 1/2009 |

* cited by examiner

AIR-FUEL RATIO CONTROL APPARATUS

TECHNICAL FIELD

The present invention relates to an air-fuel ratio control apparatus.

BACKGROUND ART

Conventionally, there has been widely known an air-fuel ratio control apparatus which controls an air-fuel ratio based on outputs of an upstream air-fuel ratio sensor and a downstream air-fuel ratio sensor, both disposed in an exhaust passage of an internal combustion engine (refer to, for example, Japanese Patent Application Laid-Open (kokai) Nos. Hei 6-317204, 2003-314334, 2004-183585, 2005-120869, and 2005-273524). The upstream air-fuel ratio sensor is disposed upstream of an exhaust gas purifying catalyst (the most upstream catalyst, if two of the catalysts are provided) for purifying an exhaust gas from cylinders, in an exhaust gas flowing direction. In contrast, the downstream air-fuel ratio sensor is disposed downstream of the exhaust gas purifying catalyst in the exhaust gas flowing direction.

As the downstream air-fuel ratio sensor, a so-called oxygen sensor (also referred to as an $O_2$ sensor) is widely used, which has (shows) a step-like response in the vicinity of the stoichiometric air-fuel ratio (Z-response: response that the output drastically changes in a stepwise fashion between a rich-side and a lean-side with respect to the stoichiometric air-fuel ratio). As the upstream air-fuel ratio sensor, the above described oxygen sensor, or a so-called A/F sensor (also referred to as a linear $O_2$ sensor) is widely used, whose output proportionally varies in accordance with the air-fuel ratio.

In those apparatuses, a fuel injection amount is feedback-controlled in such a manner that an air-fuel of the exhaust gas flowing into the exhaust gas purifying catalyst coincides with a target air-fuel ratio, based on an output signal from the upstream air-fuel ratio sensor (hereinafter, this control is referred to as a "main feedback control"). In addition to the main feedback control, a control to use an output signal from the downstream air-fuel ratio sensor in a feedback control for the fuel injection amount is also carried out (hereinafter, this control is referred to as a "sub feedback control").

Specifically, in the sub feedback control, a sub feedback correction amount is calculated based on the output signal from the downstream air-fuel ratio sensor (more specifically, based on a deviation between the output signal and a target voltage corresponding to a target air-fuel ratio). The sub feedback correction amount is used in the main feedback control so that a deviation between the air-fuel ratio of the exhaust gas corresponding to the output signal from the upstream air-fuel ratio sensor and the target air-fuel ratio is compensated.

In the mean time, as the exhaust gas purifying catalyst, a so-called three-way catalyst is widely used, which can simultaneously purify unburnt substance, such as carbon monoxide (CO) and hydrocarbon (HC), and nitrogen oxide (NOx) in the exhaust gas. The three-way catalyst has a function which is referred to as an oxygen storage function or an oxygen absorb function. The oxygen storage function is a function (1) to reduce nitrogen oxide in the exhaust gas by depriving oxygen from the nitrogen oxide when an air-fuel ratio of an air-fuel mixture is lean, so as to store the deprived oxygen inside, and (2) to release the stored oxygen to oxide unburnt substance in the exhaust gas when the air-fuel ratio of the air-fuel mixture is rich.

The above described oxygen storage function which relates to an exhaust gas purifying ability of the three-way catalyst can be maintained at a high level by activating a catalytic material (precious metal) owing to a repetition of the storage and the release of oxygen. In view of the above, an apparatus is widely known, which carries out a control (perturbation control) to forcibly fluctuate the air-fuel ratio of the exhaust gas (i.e., the air-fuel ratio of the air-fuel mixture) in order to cause the repetition of the storage and the release of oxygen in the three-way catalyst (refer to, for example, Japanese Patent Application Laid-Open (kokai Nos. Hei 2-11841, Hei 8-189399, Hei 10-131790, 2001-152913, 2005-76496, 2007-239698, 2007-56755, 2009-2170).

CITATION LIST

Patent Literature

<PTL 1> Japanese Patent Application Laid-Open (kokai) No. Hei 2-11841

<PTL 2> Japanese Patent Application Laid-Open (kokai) No. Hei 8-189399

<PTL 3> Japanese Patent Application Laid-Open (kokai) No. Hei 10-131790

<PTL 4> Japanese Patent Application Laid-Open (kokai) No. 2001-152913

<PTL 5> Japanese Patent Application Laid-Open (kokai) No. 2005-76496

<PTL 6> Japanese Patent Application Laid-Open (kokai) No. 2007-239698

<PTL 7> Japanese Patent Application Laid-Open (kokai) No. 2007-56755

<PTL 8> Japanese Patent Application Laid-Open (kokai) No. 2009-2170

SUMMARY OF THE INVENTION

Structure

An internal combustion system to which the present invention is applied comprises an internal combustion engine having cylinders in its inside, an exhaust gas purifying catalyst and a downstream air-fuel ratio sensor, both disposed in an exhaust passage (passage of an exhaust gas discharged from the cylinders). The exhaust gas purifying catalyst is configured so as to purify the exhaust gas discharged from the cylinders. The downstream air-fuel ratio sensor is disposed in the exhaust passage at a position downstream of the exhaust gas purifying catalyst in an exhaust gas flowing direction, and is configured so as to generate an output corresponding to an air-fuel ratio of the exhaust gas at the position.

It should be noted that an upstream air-fuel ratio sensor may be provided to the internal combustion engine system. The upstream air-fuel ratio sensor is disposed in the exhaust passage at a position upstream of the exhaust gas purifying catalyst and the downstream air-fuel ratio sensor in the exhaust gas flowing direction, and is configured so as to generate an output corresponding to an air-fuel ratio of the exhaust gas at the position.

An air-fuel ratio control apparatus of the present invention is an apparatus which controls an air-fuel ratio of the internal combustion engine based on at least the output of the downstream air-fuel ratio sensor, characterized by comprising an inverse direction spike introducing section and an inverse direction spike interval setting section. The inverse direction spike introducing section is configured so as to introduce, while an air-fuel ratio correction required by the output of the downstream air-fuel ratio sensor is being carried out, air-fuel ratio spikes (inverse direction spikes) having an inverse direction with respect to the correction. That is, the inverse direction spike is an air-fuel ratio spike which temporarily changes the air-fuel ratio of the exhaust gas in the direction opposite to a direction of the air-fuel correction required based on the output of the downstream air-fuel ratio sensor with respect to a target air-fuel ratio. The inverse direction spike interval setting section is configured so as to set an inverse direction spike interval based on an operating state/condition of the internal combustion engine system. The inverse direction spike interval is an interval between two of the inverse direction spikes adjacent/next to each other in time.

The air-fuel ratio control apparatus may further comprise a deviation obtaining section which obtains a deviation/difference/error between the output of the downstream air-fuel ratio sensor and a predetermined target value (e.g., value corresponding to the stoichiometric air-fuel ratio). In this case, the inverse direction spike interval setting section may be configured so as to set the inverse direction spike interval based on the deviation.

The inverse direction spike interval setting section may be configured so as to set the inverse direction spike interval based on a load of the internal combustion engine (i.e., an intake air amount of the cylinder). In this case, specifically, the inverse direction spike interval setting section may be configured so as to shorten the inverse direction spike interval as the load becomes higher (i.e., as the intake air amount becomes larger), for example.

The inverse direction spike interval setting section may be configured so as to set the inverse direction spike interval based on a deterioration state/degree of the exhaust gas purifying catalyst. In this case, specifically, the inverse direction spike interval setting section may be configured so as to shorten the inverse direction spike interval as the exhaust gas purifying catalyst further deteriorates.

The air-fuel ratio control apparatus may further comprise an inverse direction spike time setting section which sets an inverse direction spike time (duration time of the single inverse direction spike) based on the operating state/condition of the internal combustion engine system. In this case, the inverse direction spike time setting section may be configured so as to set the inverse direction spike time based on the load of the internal combustion engine. Further, the inverse direction spike time setting section may be configured so as to set the inverse direction spike time based on the deterioration state/degree of the exhaust gas purifying catalyst.

The air-fuel ratio control apparatus may further comprise an inverse direction spike strength setting section configured so as to set, based on the intake air amount of the cylinder, an inverse direction spike strength which is an air-fuel ratio change width/range in the single inverse direction spike.

The air-fuel ratio control apparatus may further comprise a downstream learning condition determining section which allows/permits a learning for compensating a steady error of the output of the downstream air-fuel ratio sensor. In this case, the downstream learning condition determining section is configured so as to permit the learning based on the inverse direction spike interval. Further, in this case, the air-fuel ratio control apparatus is configured so as to execute the learning by correcting the target value at a point in time at which a direction of a change in the output of the downstream air-fuel ratio sensor becomes a direction opposite to the direction of the air-fuel ratio correction required by the output of the downstream air-fuel ratio sensor while the inverse direction spike is being introduced.

The air-fuel ratio control apparatus may further include an upstream learning condition determining section which permits a learning for compensating a steady error of the upstream air-fuel ratio sensor. In this case, the upstream learning condition determining section is configured so as to permit the learning based on the inverse direction spike interval.

Effect

In the air-fuel ratio control apparatus thus configured, the downstream air-fuel ratio sensor generates the output corresponding to the air-fuel ratio (oxygen concentration) in the exhaust gas which is discharged from (flowed out from) the exhaust gas purifying catalyst. When the exhaust gas flows into the exhaust gas purifying catalyst, exhaust gas purifying activity (reaction for the storage or release of oxygen) occurs from an upstream end (a front end, or an end into which the exhaust gas flows) in the exhaust gas flowing direction. Thus, a substantial portion (reacting portion) at which the exhaust gas is being purified gradually moves toward downstream side (a rear end, or an end from which the exhaust gas flows out).

Thereafter, when the exhaust gas purifying activity (reaction for the storage or release of oxygen) is saturated in the whole exhaust gas purifying catalyst (i.e. portion from the front end to the rear end), and thus, the exhaust gas can not become treated by the exhaust gas purifying catalyst, a blow-out of the exhaust gas occurs with respect to the exhaust gas purifying catalyst. At this stage, typically, the air-fuel ratio (oxygen concentration) of the exhaust gas reaching the downstream air-fuel ratio sensor drastically changes, and therefore, the output of the downstream air-fuel ratio sensor drastically changes.

In contrast, in the air-fuel ratio control apparatus of the present invention, while the air-fuel ratio correction required by the output of the downstream air-fuel ratio sensor is being performed, the inverse direction spike which has a direction opposite to the air-fuel ratio correction direction is introduced at an appropriate interval which is in accordance with the operating state/condition of the internal combustion engine system. Accordingly, occurrence of a transient output of the downstream air-fuel ratio sensor is suppressed as much as possible, and more efficient purification of the exhaust gas is carried out.

More specifically, for example, when the output of the downstream air-fuel ratio sensor inverts from the rich side to the lean side, the air-fuel ratio correction toward the rich direction is required. At this output inverse point in time, the purifying treatment capability for nitrogen oxide (storage of oxygen) of the exhaust gas purifying catalyst is completely saturated.

After the air-fuel ratio correction toward the rich direction is started, the air-fuel ratio of the exhaust gas flowing into the exhaust gas purifying catalyst is made rich. Consequently, purification (oxidization) of the unburnt substances in the exhaust gas having the rich air-fuel ratio is carried out in a portion in the vicinity of the upstream end of the exhaust gas purifying catalyst in the exhaust gas flowing direction, and thus, the purifying treatment capability for nitrogen oxide is restored (stored oxygen is released). Thereafter, the portion at which the exhaust gas having the rich air-fuel ratio is purified and the portion at which the purifying treatment capability for nitrogen oxide is restored gradually move toward the downstream side.

In the present invention, the lean spikes, having a direction opposite to the air-fuel ratio correction direction required by the rich request based on the output value of the downstream air-fuel ratio sensor, are introduced under a condition (interval, etc.) appropriate for the operating state/condition of the internal combustion engine system. At this point in time, in the upstream portion (upstream end portion) of the exhaust gas purifying catalyst in the exhaust gas flowing direction, the nitrogen oxide in the exhaust gas having the lean air-fuel ratio provided by the lean spikes is purified. In the meantime, an average of the air-fuel ratio of the exhaust gas is still rich, and thus, the portion at which the exhaust gas having the rich air-fuel ratio is purified and the portion at which the purifying treatment capability for the nitrogen oxide is restored continue to gradually move toward the downstream side.

Accordingly, in the exhaust gas purifying catalyst, while the exhaust gas generated by the lean spikes is appropriately treated at the upstream portion in the exhaust gas flowing direction, the catalytic reaction generated by the air-fuel ratio correction toward the rich side gradually progresses at the middle portion and the downstream portion. Consequently, a change in the air-fuel ratio (oxygen concentration) of the exhaust gas at the middle portion and the downstream portion is moderated, and therefore, the occurrence of the transient output of the downstream air-fuel ratio sensor is suppressed as much as possible. Further, the exhaust gas purifying capability (oxygen storage capability or oxygen release capability) at the middle portion and the downstream portion is fully utilized.

Similarly, for example, when the output of the downstream air-fuel ratio sensor inverts from the lean side to the rich side, the air-fuel ratio correction toward the lean direction is required. At this output inverse point in time, the purifying treatment capability for unburnt substance (release of oxygen) of the exhaust gas purifying catalyst is completely saturated.

After the air-fuel ratio correction toward the lean direction is started, the air-fuel ratio of the exhaust gas flowing into the exhaust gas purifying catalyst is made lean. Consequently, purification (reduction) of the nitrogen oxide in the exhaust gas having the lean air-fuel ratio is carried out in a portion in the vicinity of the upstream end of the exhaust gas purifying catalyst in the exhaust gas flowing direction, and thus, the purifying treatment capability for the unburnt substances is restored (oxygen is stored). Thereafter, the portion at which the exhaust gas having the lean air-fuel ratio is purified and the portion at which the purifying treatment capability for the unburnt substances is restored gradually move toward the downstream side.

In the present invention, the rich spikes, having a direction opposite to the air-fuel ratio correction direction required by the lean request based on the output value of the downstream air-fuel ratio sensor, are introduced under a condition (interval, etc.) appropriate for the operating state/condition of the internal combustion engine system. At this point in time, in the upstream portion (upstream end portion) of the exhaust gas purifying catalyst in the exhaust gas flowing direction, the unburnt substances in the exhaust gas having the rich air-fuel ratio provided by the rich spikes are purified. In the meantime, an average of the air-fuel ratio of the exhaust gas is still lean, and thus, the portion at which the exhaust gas having the lean air-fuel ratio is purified and the portion at which the purifying treatment capability for the unburnt substances is restored continue to gradually move toward the downstream side.

Accordingly, in the exhaust gas purifying catalyst, while the exhaust gas generated by the rich spikes is appropriately treated at the upstream portion in the exhaust gas flowing direction, the catalytic reaction generated by the air-fuel ratio correction toward the lean side gradually progresses at the middle portion and the downstream portion. Consequently, a change in the air-fuel ratio (oxygen concentration) of the exhaust gas at the middle portion and the downstream portion is moderated, and therefore, the occurrence of the transient output of the downstream air-fuel ratio sensor is suppressed as much as possible. Further, the exhaust gas purifying capability (oxygen storage capability or oxygen release capability) at the middle portion and the downstream portion is fully utilized.

DESCRIPTION OF EMBODIMENTS

Embodiments of the present invention will be described with reference to the drawings. The following description of the embodiments is nothing more than the specific description of mere example embodiments of the present invention to the possible extent in order to fulfill description requirements (descriptive requirement and enabling requirement) of specifications required by law. Thus, as will be described later, naturally, the present invention is not limited to the specific configurations of embodiments to be described below. Modifications that can be made to the embodiments are collectively described herein principally at the end, since insertion thereof into the description of the embodiments would disturb understanding of consistent description of the embodiments.

System configuration

Figure 1:
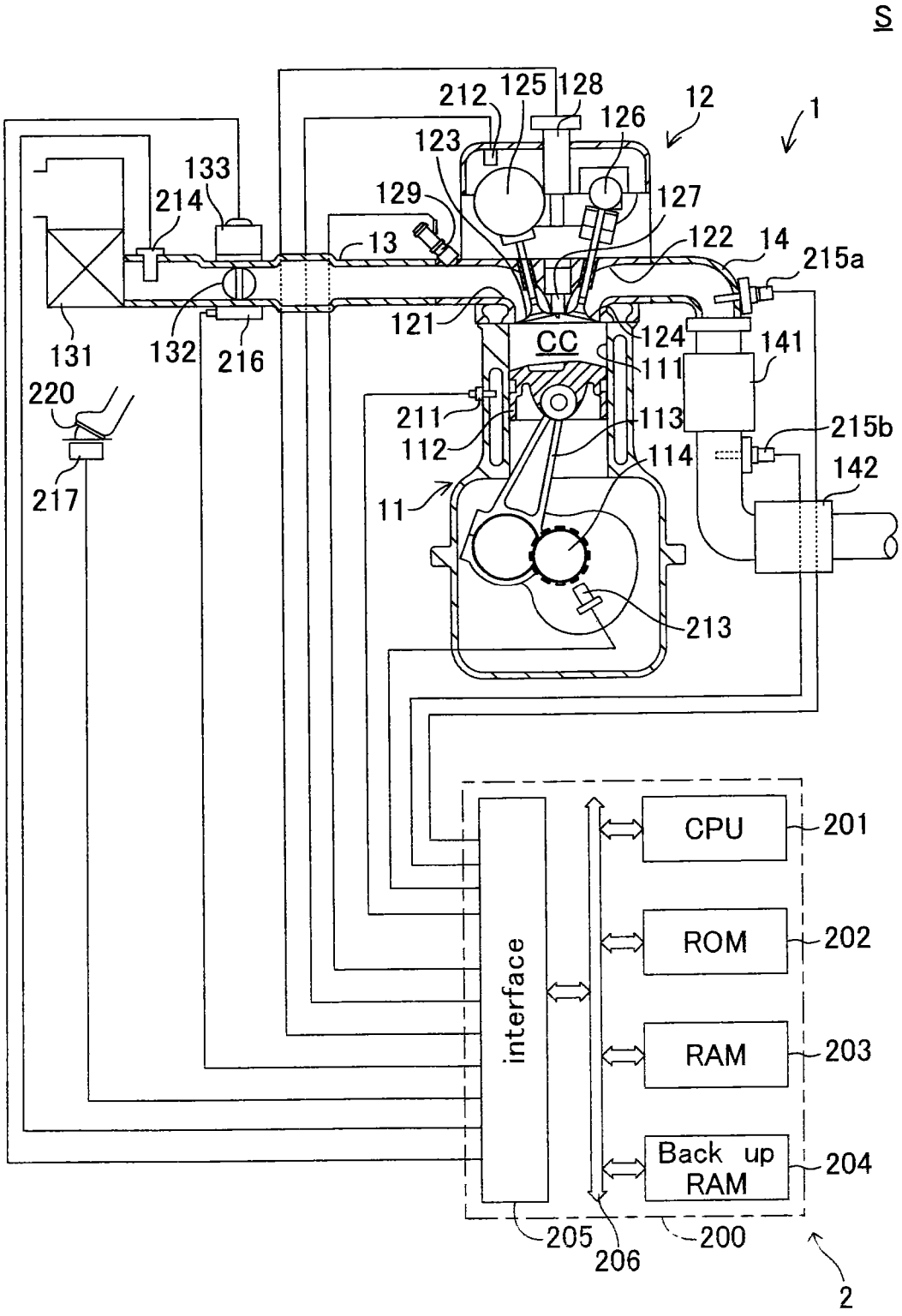
FIG. 1 is a schematic view of a whole structure of an internal combustion engine system to which an embodiment of the present invention is applied.

FIG. 1 schematically shows a configuration of an internal combustion engine system S (which is, hereinafter, simply referred to as a "system S", and corresponds to, for example, a vehicle), which is an object to which the present invention is applied. The system S includes a piston reciprocating type spark-ignition multi-cylinder four-cycle engine 1 (hereinafter, simply referred to as an "engine 1"), and a engine controller 2 serving as one embodiment of an air-fuel ratio control apparatus of the present invention. It should be noted that FIG. 1 shows a sectional view of the engine 1 cut by a plane, which passes through a specific cylinder, and is orthogonal to a cylinder layout direction.

Engine

Referring to FIG. 1, the engine 1 comprises a cylinder block 11 and a cylinder head 12. They are fixed to each other by means of unillustrated bolts and the like. An intake passage 13 and an exhaust passage 14 are connected to the engine (specifically, cylinder block 11).

Cylinder bores 111, each of which is a substantially cylindrical through hole so as to form a cylinder, are formed in the cylinder block 11. As described above, in the cylinder block 11, a plurality of the cylinder bores 111 are arranged in a straight line along the cylinder layout direction. A piston 112 is accommodated in each of the cylinder bores 111 in such a manner that the piston 112 can reciprocate along a central axis of the cylinder bore 111 (hereinafter referred to as a "cylinder central axis").

In the cylinder block 11, a crank shaft 113 is rotatably supported so as to be arranged in parallel with the cylinder layout direction. The crank shaft 113 is connected with the pistons 112 through connecting rods 114 so as to be rotated based on the reciprocating motion of the pistons 112 along the cylinder central axis.

The cylinder head 12 is fixed to the cylinder block 11 at one end of the cylinder block 11 in the cylinder central axis direction (end of the cylinder block 11 in a side of a top dead center of the piston 112: upper end in the figure). A plurality of concave potions are formed at an end surface of the cylinder head 12 in the side of the cylinder block 11 so as to be located at positions corresponding to the cylinder bores 111. That is, a combustion chamber CC is formed by a space inside of the cylinder bore 111, the space being located in the side of the cylinder head 12 with respect to a top surface of the piston 112 (upper side in the figure), and by a space inside of the above described concave potion, when the cylinder head 12 is connected and fixed to the cylinder block 11.

An intake port 121 and an exhaust port 122 is provided so as to communicate with the combustion chamber CC in the cylinder head 12. An intake passage 13 (including an intake manifold, a surge tank, and the like) is connected with the intake ports 121. Similarly, an exhaust passage 14 including an exhaust manifold is connected with the exhaust ports 122. Further, intake valves 123, exhaust valves 124, a intake valve control device 125, an exhaust cam shaft 126, spark plugs 127, igniters 128, and injectors are provided to the cylinder head 12.

The intake valve 123 is a valve for opening and closing the intake port 121 (that is, valve for controlling communicating state between the intake port 121 and the combustion chamber CC). The exhaust valve 124 is a valve for opening and closing the exhaust port 122 (that is, valve for controlling communicating state between the exhaust port 122 and the combustion chamber CC). The intake valve control device 125 comprises a mechanism for controlling a rotation angle (phase angle) between unillustrated intake cam and an unillustrated intake cam shaft (since the mechanism is well known, the description is omitted in the present specification). The exhaust cam shaft 126 is configured so as to drive the exhaust valve 124.

The spark plug 127 is fixed in such a manner that a spark generation electrode at a tip of the plug 127 is exposed inside of the combustion chamber CC. The igniter 128 comprises an ignition coil to generate a high voltage supplied to the spark plug 127. The injector 129 is configured and disposed so as to inject a fuel, which is supplied to the combustion chamber CC, into the intake port 121.

Intake Exhaust Passages

A throttle valve 132 is disposed in the intake passage 13 at a position between an air filter 131 and the intake port 121. The throttle valve 132 is configured so as to vary a cross sectional area of the intake passage 13 by being rotated by a throttle valve actuator 133.

An upstream catalytic converter 141 and a downstream catalytic converter 142 are disposed in the exhaust passage 14. The upstream catalytic converter 141, which corresponds to an "exhaust gas purifying catalyst" of the present invention, is an exhaust gas purifying catalytic unit into which exhaust gas discharged from the combustion chambers CC to the exhaust ports 122 firstly flows, and is disposed upstream of the downstream catalytic converter 142 in the exhaust gas flowing direction. Each of the upstream catalytic converter 141 and the downstream catalytic converter 142 includes a three-way catalyst in its inside, and is configured so as to be capable of simultaneously purifying unburnt substance (such as CO, HC, or the like) in the exhaust gas and nitrogen oxide in the exhaust gas.

Controller

The engine controller 2 comprises an electronic control unit 200 (hereinafter, simply referred to as an "ECU 200") which constitutes each of sections of the present invention. The ECU 200 comprises a CPU 201, a ROM 202, a RAM 203, a backup RAM 204, an interface 205, and a bidirectional bus 206. The CPU 201, the ROM 202, the RAM 203, the backup RAM 204, the interface 205 are mutually connected with each other by the bidirectional bus 206.

Routines (programs) executed by the CPU 201, tables (including look-up tables and maps) to which the CPU 201 refers when it executes the routines, or the like are stored in the ROM 202 in advance. The RAM 203 temporarily stores data as needed when the CPU 201 executes the routines.

The backup RAM 204 stores data while a power is supplied when the CPU 201 executes the routines, and holds the stored data after power is shut off. Specifically, the backup RAM 204 stores data in such a manner the data is overwritten, the data including a part of obtained (detected or estimated) operating condition parameters, a part of the above described tables, a result of the correction (learning) of the tables, or the like.

The interface 205 is electrically connected with actuators of the system S (the intake valve control device 125, the igniters 128, the injectors 129, the throttle valve actuator 133, or the like) and with various sensors described later. That is, the interface 205 conveys detected signals from the various sensors described later to the CPU 201, and coveys drive signals for driving the above described actuators to the actuators (the drive signals being generated by operations (execution of the above described routines) performed by the CPU 201 based the above described detected signals).

The system S is provided with the various sensors including a cooling water temperature sensor 211, a cam position sensor 212, a crank position sensor 213, an air flow meter 214, an upstream air-fuel ratio sensor 215*a*, a downstream air-fuel ratio sensor 215*b*, a throttle position sensor 216, an acceleration opening sensor 217, and the like.

The cooling water temperature sensor 211 is fixed in the cylinder block 11 so as to output a signal indicative of a temperature Tw of a cooling water in the cylinder block 11. The cam position sensor 212 is fixed to the cylinder head 12 so as to output a signal (G2 signal) whose wave shape includes pulses generated in accordance with a rotation angle of the above described unillustrated intake cam shaft (included in the intake valve control device 125) for having the intake valves 123 reciprocate.

The crank position sensor 213 is fixed to the cylinder block 11 so as to output a signal whose wave shape includes pulses generated in accordance with a rotation angle of the crank shaft 13. The air flow meter 214 is fixed in the intake passage 13 so as to output a signal corresponding to an intake air flow rate Ga which is a mass per unit time of an intake air flowing in the intake passage 13.

The upstream air-fuel ratio sensor 215*a* and the downstream air-fuel ratio sensor 215*b* are disposed in the exhaust passage 14. The upstream air-fuel ratio sensor 215*a* is disposed upstream of the upstream catalytic converter 141 in the exhaust gas flowing direction. The downstream air-fuel ratio sensor 215*b* is disposed downstream of the upstream catalytic converter 141 in the exhaust gas flowing direction, specifically, at a position between the upstream catalytic converter 141 and the downstream catalytic converter 142.

Figure 2:
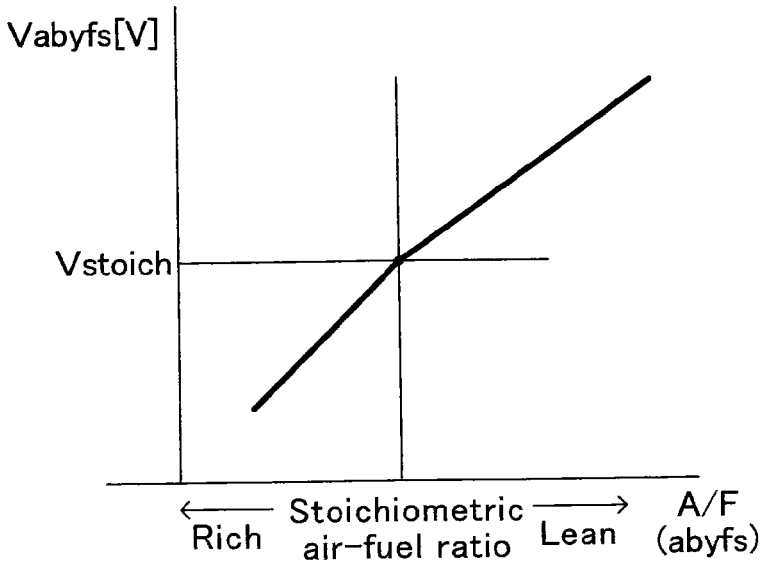
FIG. 2 is a graph showing a relationship between an output of an upstream air-fuel ratio sensor shown in FIG. 1 and an air-fuel ratio.
Figure 3:
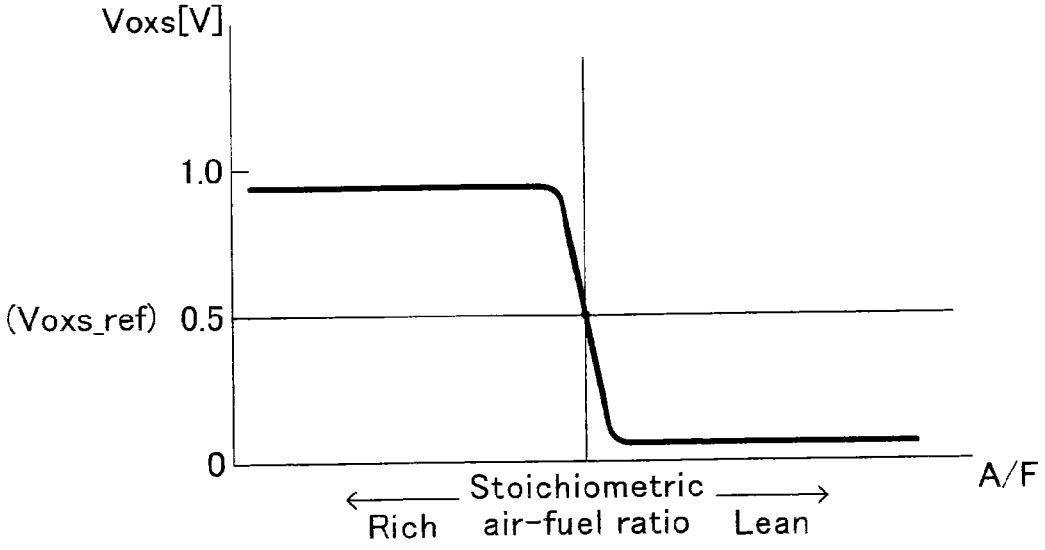
FIG. 3 is a graph showing a relationship between an output of a downstream air-fuel ratio sensor shown in FIG. 1 and an air-fuel ratio.

Each of the upstream air-fuel ratio sensor 215*a* and the downstream air-fuel ratio sensor 215*b* is configured so as to output a signal corresponding to an air-fuel ratio (oxygen concentration) of the exhaust gas flowing through each of the positions at which each of those sensors is disposed. Specifically, the upstream air-fuel ratio sensor 215*a* is a limiting-current-type oxygen concentration sensor (so-called A/F sensor), and is configured so as to generate an output which linearly varies in accordance with an air-fuel ratio over a wide range, as shown in FIG. 2. In contrast, the downstream air-fuel ratio sensor 215*b* is an electro-motive-force-type (concentration-cell-type) oxygen concentration sensor (so-called $O_2$ sensor), and is configured so as to generate an output as shown in FIG. 3, wherein the output has a step-like response (Z-response) with respect to a change in the air-fuel ratio, such that the output becomes about 0.5 V, drastically changes in the vicinity of the stoichiometric air-fuel ratio, becomes constant around 0.9 V in the rich side with respect to the stoichiometric air-fuel ratio, and becomes constant around 0.1 V in the lean side with respect to the stoichiometric air-fuel ratio.

The throttle position sensor 216 is disposed at a position corresponding to the throttle valve 132. The throttle position sensor 216 is configured so as to output a signal corresponding to an actual rotation phase of the throttle valve 132 (i.e., throttle valve opening TA). The acceleration opening sensor 217 is configured so as to output a signal corresponding to an operation amount (acceleration operation amount PA) of an accelerator pedal 220.

Outline of Operations by the Configuration of the Embodiment

The ECU 200 of the present embodiment performs, based on the outputs of the upstream air-fuel ratio sensor 215*a* and the downstream air-fuel ratio sensor 215*b*, an air-fuel ratio control of the engine 1, that is, a control of a fuel injection amount (injection time duration) for the injector 129.

Specifically, the fuel injection amount is feedback-controlled (main feedback control) based on the output from the upstream air-fuel ratio sensor 215*a*, in such a manner that an air-fuel ratio of the exhaust gas flowing into the upstream catalytic converter 141 coincides with a target air-fuel ratio (required air-fuel ratio). In addition, with this main feedback control, a feedback control (sub feedback control) is carried out in such a manner that the fuel injection amount is feedback controlled based on the output of the downstream air-fuel ratio sensor 215*b*. In this sub feedback control, an air-fuel ratio (required air-fuel ratio) of the exhaust gas flowing into the upstream catalytic converter 141 (i.e., of a fuel mixture supplied to the combustion chambers CC) is determined, based on the output of the downstream air-fuel ratio sensor 215*b*.

Figure 4:
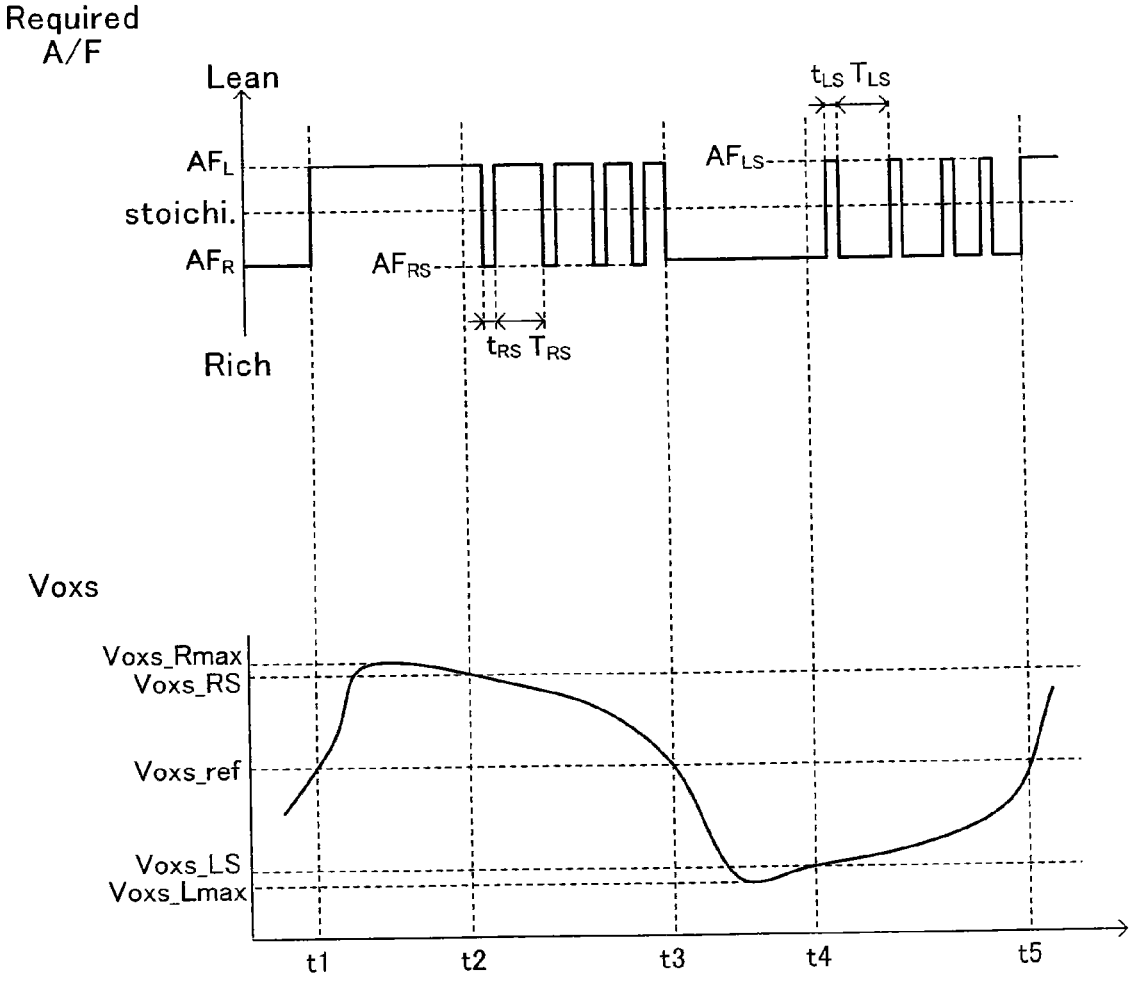
FIG. 4 is a timeline chart showing an aspect of a control performed by the present embodiment.

FIG. 4 is a timeline chart showing an aspect of the control performed by the present embodiment. "Voxs" in the lower side of FIG. 4 shows a change in the output Voxs of the downstream air-fuel ratio sensor 215*b* with the passage of time, "required A/F" in the upper side of FIG. 4 shows a required/requested air-fuel ratio which is set based on the output Voxs of the downstream air-fuel ratio sensor 215*b*.

Referring to FIG. 4, the output of the downstream air-fuel ratio sensor 215*b* is in the lean side (i.e., is lower than a target value Voxs_ref corresponding to the stoichiometric air-fuel ratio) before a point in time t1. Therefore, before the point in time t1, the required air-fuel ratio is set to the rich side (rich request) based on the output Voxs of the downstream air-fuel ratio sensor 215*b*. While the rich request is occurring, the required air-fuel ratio is set to a value deviated toward the rich side from the stoichiometric air-fuel ratio (refer to $AF_R$ in the figure).

While the air-fuel ratio correction based on the rich request is being carried out, the exhaust gas having the rich air-fuel ratio flows into the upstream catalytic converter 141. Accordingly, in the three-way catalyst included in the upstream catalytic converter 141 (hereinafter, simply referred to as the "three-way catalyst"), oxygen release occurs in order to purify (oxidize) the exhaust gas having the rich air-fuel ratio. When the oxygen release is saturated in a whole of the three-way catalyst, the exhaust gas having the rich air-fuel ratio blows through the upstream catalytic converter 141, and thus, the output Voxs of the downstream air-fuel ratio sensor 215*b* inverts from the lean side to the rich side.

From the point in time t1 at which the output Voxs of the downstream air-fuel ratio sensor 215*b* inverts from the lean side to the rich side, the required air-fuel ratio is set to the lean side (lean request) based on the output Voxs. While the lean request is occurring, the required air-fuel ratio is set to a value greatly deviated toward the lean side from the stoichiometric air-fuel ratio (refer to $AF_L$ in the figure). As a result, a rate of storing oxygen is increased, and thus, the oxygen storage function is utilized at a maximum.

Meanwhile, the oxygen release is substantially saturated immediately after the point in time t1, as described above. Accordingly, if rich spikes are introduced immediately after the start of the lean request at the point in time t1, there is a possibility that the exhaust gas having the rich air-fuel ratio generated by the rich spikes can not be purified (oxidized).

In view of the above, the rich spikes are prohibited until a point in time t2 after a predetermined time from the point in time t1, in the present embodiment. The point in time t2 is a point in time at which the output Voxs of the downstream air-fuel ratio sensor 215*b* slightly decreases from a value (rich side maximum value or rich side extreme value) Voxs_Rmax which corresponds to a rich side amplitude assuming the target value Voxs_ref corresponding to the stoichiometric air-fuel ratio as a center, and reaches a rich spike start value Voxs_RS.

From the point in time t1 to the point in time t2, the exhaust gas having the lean air-fuel ratio in accordance with the lean request flows into the three-way catalyst, oxygen storage starts from the upstream end of the three-way catalyst in the exhaust gas flowing direction. After the oxygen storage is saturated at the upstream portion of the three-way catalyst in the exhaust gas flowing direction, a portion which is storing oxygen gradually moves toward the downstream side. In this manner, the saturation state of the oxygen release are sequentially removed from the upstream end of the three-way catalyst, and thus, it becomes possible to purify the exhaust gas having the rich air-fuel ratio generated by the rich spikes that will be introduced later. It should be noted that, since the rich spikes are prohibited from the point in time t1 to the point in time t2, the output Voxs of the downstream air-fuel ratio sensor 215*b* promptly decreases from the rich side extreme value Voxs_Rmax to reach the rich spike start value Voxs_RS.

After the point in time t2, the rich spikes are permitted, and thus, the rich spikes are introduced, the exhaust gas having the rich air-fuel ratio generated by the rich spikes is appropriately purified at the upstream end of the three-way catalyst in the exhaust gas flowing direction. Meanwhile, an average of the air-fuel ratio of the exhaust gas is still lean, and thus, the portion which is storing oxygen moves from a middle portion toward the downstream end side of the three-way catalyst in the exhaust gas flowing direction. Consequently, the change in the output Voxs of the downstream air-fuel ratio sensor 215*b* becomes gradual (moderated) as shown in FIG. 4, and the oxygen storage capability of the three-way catalyst is fully utilized. The rich spike is permitted until a point in time t3 at which the output Voxs of the downstream air-fuel ratio sensor 215*b* inverts from the rich side to the lean side. It should be noted that a time duration of one rich spike is 0.1 to 1 sec. and the rich spike is introduced once per 1 to 5 sec. for example (same applies to the lean spike described later).

In the present example, as shown in FIG. 4, a rich spike interval (interval between the rich spikes next to each other in time) $T_{RS}$ is set in accordance with a difference ΔVoxs between the output Voxs of the downstream air-fuel ratio sensor 215*b* and the target value Voxs_ref. More specifically, the rich spike interval $T_{RS}$ is set so as to be larger as the difference ΔVoxs is larger, and so as to be smaller as the difference ΔVoxs is smaller. Consequently, since the exhaust gas having the deep lean air-fuel ratio can be introduced into the three-way catalyst, a maximum utilization of the oxygen storage function are ensured, and the occurrence of the transient output of the downstream air-fuel ratio sensor 215*b* is suppressed as much as possible.

In the present example, the rich spike interval $T_{RS}$ is set in accordance with an engine load. More specifically, the rich spike interval $T_{RS}$ is set so as to be smaller as the engine load is higher. In addition, a rich spike time (time duration of one rich spike) $t_{RS}$ is set so as to be shorter as the engine load is higher. Consequently, an optimal execution state of the rich spike (the rich spike interval $T_{RS}$ and the rich spike time $t_{RS}$) is maintained.

For example, the rich spike interval $T_{RS}$ is set to be large in a region in which the engine load is low (i.e., low Ga region), and thus, the exhaust gas having the lean air-fuel ratio is introduced into the three-way catalyst for a longer time. Consequently, the oxygen storage function of the three-way catalyst can be more greatly emerged. To the contrary, in a region in which the engine load is high (i.e., high Ga region), the exhaust gas having the lean air-fuel ratio can originally be introduced into the three-way catalyst in a great amount. Thus, in such a region, the rich spike interval $T_{RS}$ is set to be smaller, so that a deviation toward the lean side of the average air-fuel ratio during the lean request is reduced to decrease the emission.

Further, in the present example, the rich spike interval $T_{RS}$ and the rich spike time $t_{RS}$ are set in accordance with a deterioration state of the three-way catalyst. More specifically, the rich spike interval $T_{RS}$ is set so as to be smaller and the rich spike interval $T_{RS}$ is set so as to be shorter, as the deterioration of the three-way catalyst progresses (that is, as a value of an oxygen storage capability obtained according to an on-board diagnosis becomes smaller). Consequently, the emission can be reduced.

When the oxygen storage is saturated in the three-way catalyst, and thus, the output Voxs of the downstream air-fuel ratio sensor 215*b* inverts from the rich side to the lean side at the point in time t3, the rich request starts. While the rich request is occurring, the required air-fuel ratio is set to a value greatly deviated toward the rich side from the stoichiometric air-fuel ratio (refer to $AF_R$ in the figure). As a result, a rate of releasing oxygen is increased, and thus, the oxygen storage function is utilized at a maximum.

At this point in time, similarly to the above description, the lean spikes are prohibited until a predetermined time elapses from the point in time t3. Consequently, a portion which is capable of storing oxygen at the upstream end portion in the exhaust gas flowing direction of the three-way catalyst is generated, the portion being capable of treating the lean spikes after a point in time t4. Further, the output Voxs of the downstream air-fuel ratio sensor 215*b* promptly increases from a lean side extreme value Voxs_Lmax described later to reach the lean spike start value Voxs_LS.

When the point in time t4 after the predetermined time from the point in time t3 comes, the lean spikes are permitted. The point in time t4 is a point in time at which the output Voxs of the downstream air-fuel ratio sensor 215*b* slightly increases from the value (lean side maximum value or lean side extreme value) Voxs_Lmax which corresponds to the lean side amplitude assuming the target value Voxs_ref corresponding to the stoichiometric air-fuel ratio as a center, and reaches the lean spike start value Voxs_LS. Consequently, the change in the output Voxs of the downstream air-fuel ratio sensor 215*b* becomes gradual (moderated) as shown in FIG. 4, and the oxygen release capability of the three-way catalyst is fully utilized. The lean spike is permitted until a point in time t5 at which the output Voxs of the downstream air-fuel ratio sensor 215*b* inverts from the lean side to the rich side.

In the present example, similarly to the rich spike described above, a lean spike interval $T_{LS}$ is set in accordance with the difference ΔVoxs between the output Voxs of the downstream air-fuel ratio sensor 215*b* and the target value Voxs_ref, the engine load, and the deterioration state of the three-way catalyst. Specifically, the lean spike interval $T_{LS}$ is set in such a manner that the lean spike interval $T_{LS}$ becomes larger as the difference ΔVoxs becomes larger, becomes smaller as the engine load becomes higher, and becomes smaller as the deterioration of the three-way catalyst progresses. In addition, the lean spike time $t_{LS}$ is set in accordance with the engine load and the deterioration state of the three-way catalyst. Specifically, the lean spike time $t_{LS}$ is set in such a manner that the lean spike time $t_{LS}$ is set becomes shorter as the engine load becomes higher, and becomes shorter as the deterioration of the three-way catalyst progresses.

Furthermore, in the present embodiment, the required air-fuel ratio $AF_R$ during the rich request, a lean spike strength $AF_{LS}$ (required air-fuel ratio by the lean spike), the required air-fuel ratio $AF_L$ during the lean request, and a rich spike strength $AF_{RS}$ (required air-fuel ratio by the rich spike) are set in accordance with the engine load.

More specifically, in a region in which the engine load is low (i.e., region in which a catalyst bed temperature is low), those values are set to values which greatly deviate from the target value Voxs_ref, so that the rate of storing oxygen and the rate of releasing oxygen can be increased. In contrast, in a region in which the engine load is higher (i.e., region in which the catalyst bed temperature is high), a deviation between each of those values and the target value Voxs_ref is made small, so that the emission can be reduced.

Further, a stoichiometric air-fuel ratio for the catalyst (nominal stoichiometric air-fuel ratio for the three-way catalyst: specifically, a mid-value of a catalyst window) shifts toward the rich side as the intake air flow rate Ga becomes larger (e.g., refer to Japanese Patent Application Laid-Open (kokai) Nos. 2005-48711, 2005-351250). Accordingly, the above described required air-fuel ratio $AF_R$, the target value Voxs_ref, and the like are appropriately set so as to shift the catalyst stoichiometric air-fuel ratio toward the rich side as the load becomes higher (i.e., as the intake air flow rate becomes higher).

Concrete Example of Operations

Figure 5:
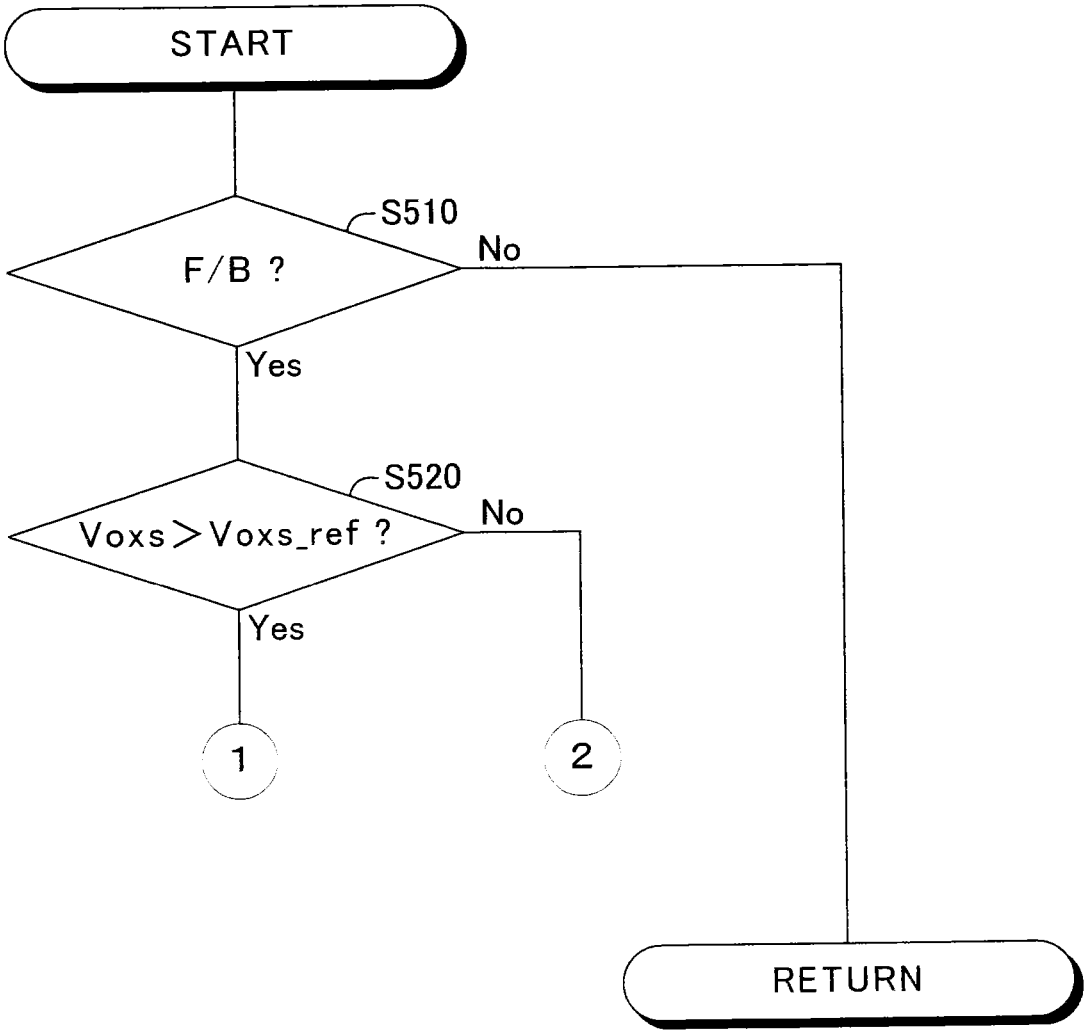
FIG. 5 is a flowchart showing an example of processes executed by a CPU shown in FIG. 1.
Figure 6:
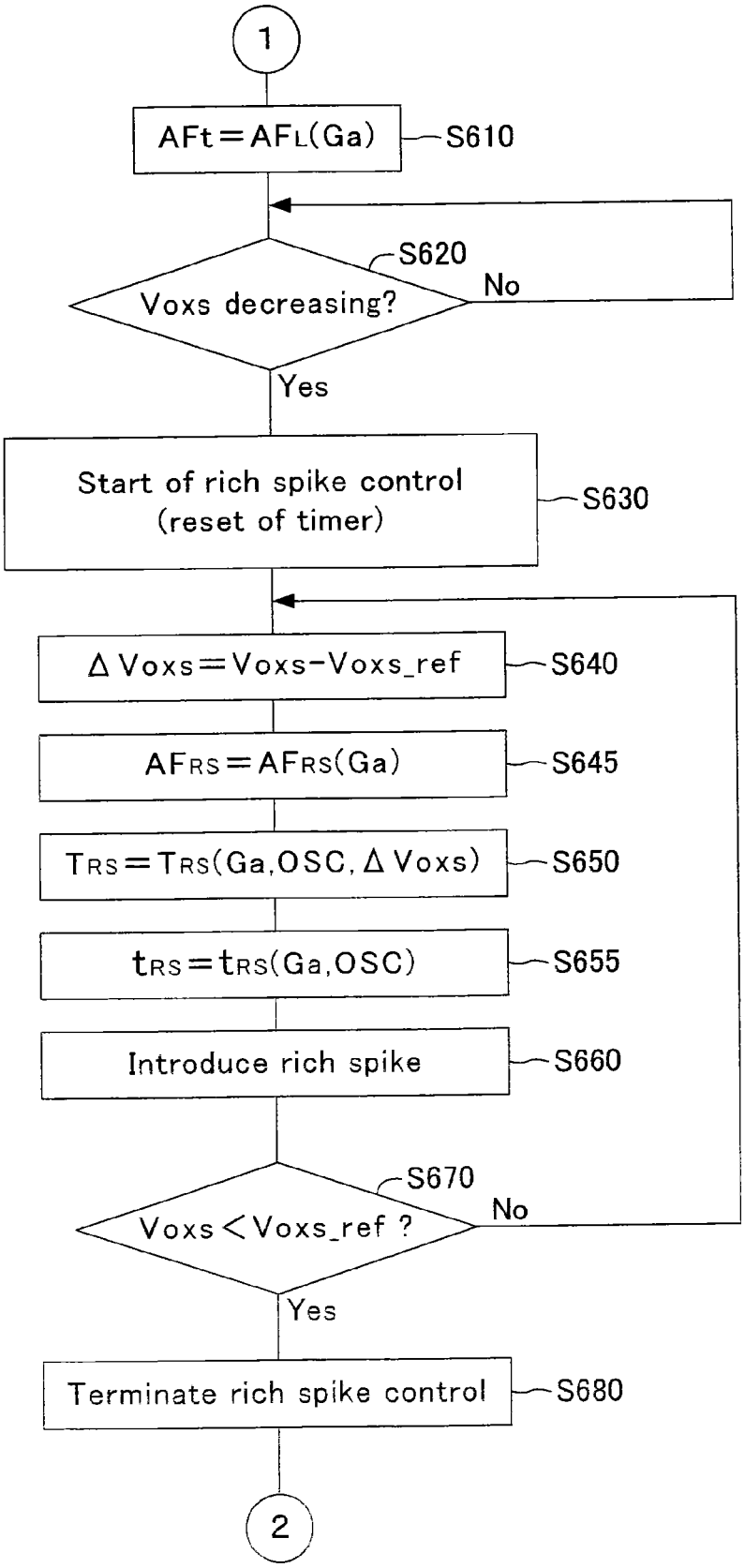
FIG. 6 is a flowchart showing the example of processes executed by the CPU shown in FIG. 1.
Figure 7:
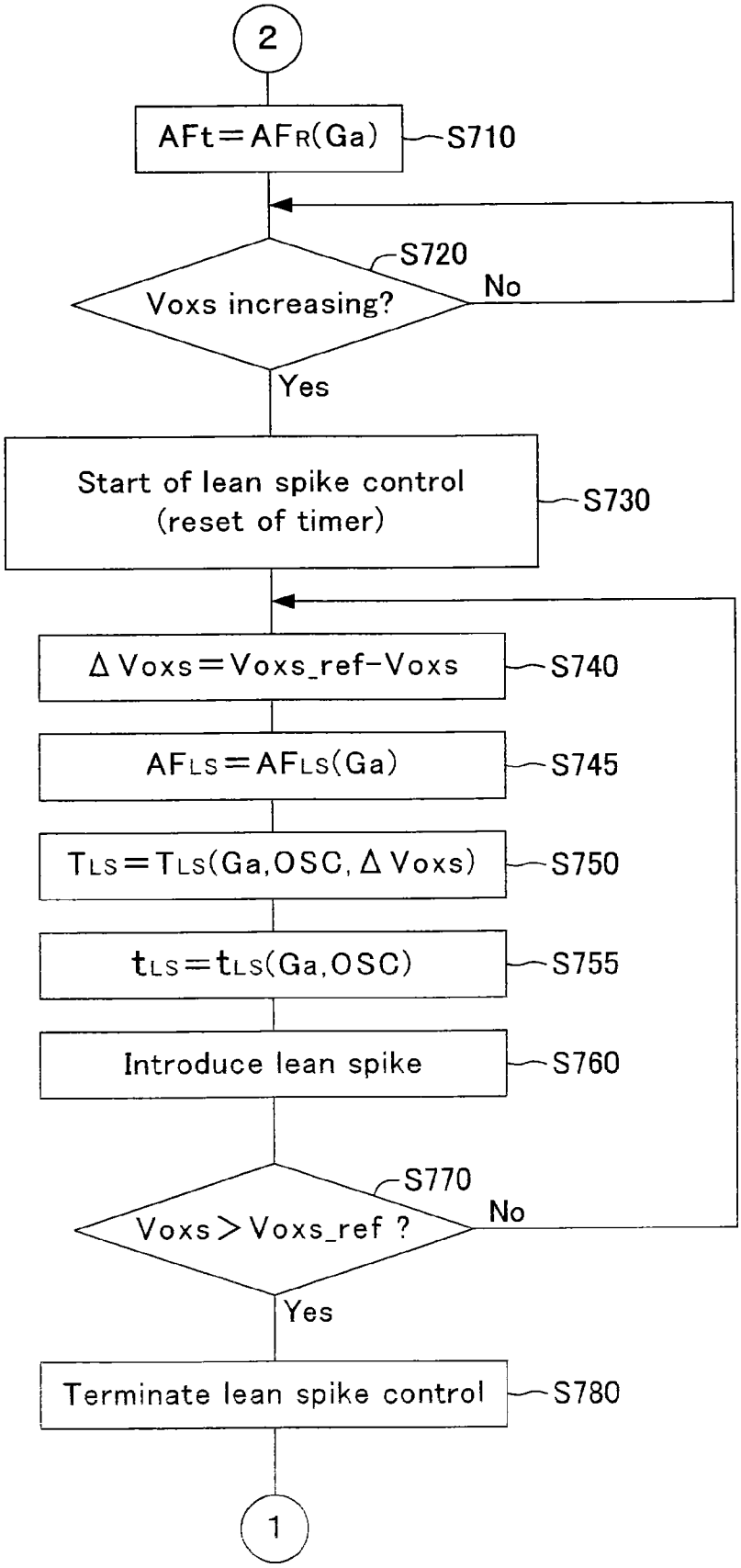
FIG. 7 is a flowchart showing the example of processes executed by the CPU shown in FIG. 1.

FIGS. 5 to 7 are flowcharts showing one example of operations performed by the CPU 201 shown in FIG. 1. Note that a "step" is abbreviated to "S" in the flowcharts in each of the figures.

Firstly, referring to FIG. 5, it is determined whether or not the feedback control is presently being performed at step 510. When the feedback control is not being performed (step 510=No), all of following processes are skipped. When the feedback control is being performed (step 510=Yes), the process proceeds to step 520 at which it is determined whether or not the present output Voxs of the downstream air-fuel ratio sensor 215*b* is higher than the target value Voxs_ref.

When the present output Voxs of the downstream air-fuel ratio sensor 215*b* is higher than the target value Voxs_ref (step 520=Yes), the process proceeds to steps from step 610 shown in FIG. 6 so that the lean request is started. Firstly, in this lean request, at step 610, the required air-fuel ratio $AF_L$ for the lean request is set based on the engine load (i.e., the intake air flow rate Ga) (using a map, or the like).

Subsequently, the process proceeds to step 620, at which it is determined whether or not the output Voxs of the downstream air-fuel ratio sensor 215*b* is decreasing (becomes smaller). Until the output Voxs of the downstream air-fuel ratio sensor 215*b* starts to decrease, the process does not proceed to step 630.

When the output Voxs of the downstream air-fuel ratio sensor 215*b* starts to decrease (step 620=Yes), the rich spike is permitted to be introduced, so that a spike control timer is reset (step 630). At this point in time, as shown in FIG. 4, the output Voxs of the downstream air-fuel ratio sensor 215*b* decreases down to a value close to the rich spike start value Voxs_RS from the rich side extreme value Voxs_Rmax.

When the rich spike control is started, the difference ΔVoxs is obtained by subtracting the target value Voxs_ref from the present output Voxs of the downstream air-fuel ratio sensor 215*b*, at step 640. Subsequently, based on the operating state parameters including the difference ΔVoxs of the system S (and using the maps etc.), the rich spike strength $AF_{RS}$, the rich spike interval $T_{RS}$, and the rich spike time $t_{RS}$ are set (steps 645-655). Thereafter, the rich spike is introduced (step 660) based on those set values and a counter value of the above described spike control timer.

That is, at step 645, the rich spike strength $AF_{RS}$ is set based on the intake air flow rate Ga. At step 650, the rich spike interval $T_{RS}$ is set based on the intake air flow rate Ga, the oxygen storage capability OSC of the three-way catalyst (this is separately obtained according to the well-known on-board diagnosis: e.g., refer to Japanese Patent Application Laid-Open (kokai) Nos. Hei 8-284648, Hei 10-311213, Hei 11-125112), and the difference ΔVoxs. Furthermore, at step 655, the rich spike time $t_{RS}$ is set based on the intake air flow rate Ga, and the oxygen storage capability OSC.

Subsequently, it is determined whether or not the present output Voxs of the downstream air-fuel ratio sensor 215*b* becomes smaller than the target value Voxs_ref (step 670). The rich spike control is permitted until the output Voxs of the downstream air-fuel ratio sensor 215*b* becomes smaller than the target value Voxs_ref (step 670=No). Consequently, as shown in FIG. 4, the rich spikes are appropriately introduced. When the output Voxs of the downstream air-fuel ratio sensor 215*b* becomes smaller than the target value Voxs_ref (step 670=Yes), the process proceeds to step 680 so that the rich spike control is terminated.

When the determination at step 520 shown in FIG. 5 is "No", or when step 680 shown in FIG. 6 is gone through (i.e., when the above described rich spike control is terminated), the process proceeds to steps after step 710 shown in FIG. 7 so that the rich request is started. In this rich request, firstly, at step 710, the required air-fuel ratio $AF_R$ for the rich request is set based on the engine load (i.e., intake air flow rate Ga) (using a map, or the like).

Subsequently, the process proceeds to step 720, at which it is determined whether or not the output Voxs of the downstream air-fuel ratio sensor 215*b* is increasing (becomes higher). Until the output Voxs of the downstream air-fuel ratio sensor 215*b* starts to increase, the process does not proceed to step 730.

When the output Voxs of the downstream air-fuel ratio sensor 215*b* starts to increase (step 720=Yes), the lean spike is permitted to be introduced, so that the spike control timer is reset (step 730). At this point in time, as shown in FIG. 4, the output Voxs of the downstream air-fuel ratio sensor 215*b* increases up to a value close to the lean spike start value Voxs LS from the lean side extreme value Voxs_Lmax.

When the lean spike control is started, the difference ΔVoxs is obtained by subtracting the present output Voxs of the downstream air-fuel ratio sensor 215*b* from the target value Voxs_ref, at step 740. Subsequently, based on the operating state parameters including the difference ΔVoxs (and using the maps etc.), the lean spike strength $AF_{LS}$, the lean spike interval $T_{LS}$, and the lean spike time $t_{LS}$ are set (steps 745-755). Thereafter, the lean spike is introduced (step 760) based on those set values and the counter value of the spike control timer.

That is, at step 745, the lean spike strength $AF_{LS}$ is set based on the intake air flow rate Ga. At step 750, the lean spike interval $T_{LS}$ is set based on the intake air flow rate Ga, the oxygen storage capability OSC, and the difference ΔVoxs. Furthermore, at step 755, the lean spike time $t_{LS}$ is set based on the intake air flow rate Ga, and the oxygen storage capability OSC.

Subsequently, it is determined whether or not the present output Voxs of the downstream air-fuel ratio sensor 215*b* becomes higher than the target value Voxs_ref (step 770). The lean spike control is permitted until the output Voxs of the downstream air-fuel ratio sensor 215*b* becomes larger than the target value Voxs_ref (step 770=No). Consequently, as shown in FIG. 4, the lean spikes are appropriately introduced.

When the output Voxs of the downstream air-fuel ratio sensor 215*b* becomes higher than the target value Voxs_ref (step 770=Yes), the process proceeds to step 780 so that the lean spike control is terminated. Thereafter, the process proceeds to step 610 shown in FIG. 6 so that the lean request is started again.

Effect of the Embodiment

As described in great detail above, in the present embodiment, when the output Voxs of the downstream air-fuel ratio sensor 215*b* inverts from the lean side to the rich side, the requested/required air-fuel ratio is set, based on the output, to the value which greatly deviates from the stoichiometric air-fuel ratio toward the lean side (refer to the required air-fuel ratio $AF_L$ for the lean request, FIG. 4). Similarly, when the output Voxs of the downstream air-fuel ratio sensor 215*b* inverts from the rich side to the lean side, the requested/required air-fuel ratio is set, based on the output, to the value which greatly deviates from the stoichiometric air-fuel ratio toward the rich side (refer to the required air-fuel ratio $AF_R$ for the rich request, FIG. 4). Consequently, the rate of storing oxygen and the rate of releasing oxygen are increased, and thus, the oxygen storage function is enhanced.

In addition, in the present embodiment, the spike in the direction opposite to the direction of the required air-fuel ratio based on the output Voxs of the downstream air-fuel ratio sensor 215*b* is introduce in accordance with the appropriate condition of the system S. Consequently, the oxygen storage function of the three-way catalyst is fully utilized, and the transient output (rapid change of the output) of the downstream air-fuel ratio sensor 215*b* is suppressed. Further, a time duration in which the output Voxs of the downstream air-fuel ratio sensor 215*b* stays in the vicinity of the extreme values (the Voxs_Lmax and the Voxs_Rmax) becomes shorter, and thus, the downstream air-fuel ratio sensor 215*b* can be used in a region in which it shows excellent responsivity.

In this manner, the configuration of the present embodiment can utilize the oxygen storage function of the three-way catalyst more effectively and has an excellent performance for suppressing the emission, as compared with a conventional air-fuel ratio control apparatus in which the sub feedback correction amount becomes smaller as a difference between the output Voxs of the downstream air-fuel ratio sensor 215*b* and the target value Voxs_ref corresponding to the stoichiometric air-fuel ratio becomes smaller, and a conventional air-fuel ratio control apparatus in which a perturbation control is merely carried out.

Modifications

The above-described embodiment is, as mentioned above, mere examples of the best mode of the present invention which the applicant of the present invention contemplated at the time of filing the present application. Accordingly, the present invention should not be limited to the embodiment described above. Therefore, various modifications to the above-described embodiment are possible, so long as the invention is not modified in essence.

Several modifications will next be exemplified. Needless to say, even modifications are not limited to those described below. Further, a plurality of the modifications are entirely or partially applicable in appropriate combination, so long as no technical inconsistencies are involved.

Limitingly construing the present invention (what is expressed functionally in each element constituting a section for solving the problem of the present invention) based on the above-described embodiment and the following modifications should not be permissible. Such a limiting construction impairs the interests of an applicant (particularly, an applicant who is motivated to file as quickly as possible under the first-to-file system) while unfairly benefiting imitators, and is thus impermissible.

The present invention is not limited to the concrete structure of the apparatus disclosed in the above described embodiment. For example, the present invention may be applicable to a gasoline engine, a diesel engine, a methanol engine, a bioethanol engine, and any type of internal combustion engines. There is no limitation on the number of cylinders, a cylinder layout (straight, V-type, horizontally-opposed), a type for supplying fuel, and a type for ignition.

In-cylinder fuel injectors for directly injecting the fuel into the combustion chambers may be provided in addition to or in place of the injectors 120 (e.g., refer to Japanese Patent Application Laid-Open (kokai) No. 2007-278137). The present invention is preferably applicable to such a configuration. The upstream air-fuel ratio sensor 215*a* and the downstream air-fuel ratio sensor 215*b* may be fixed to a casing of the upstream catalytic converter 141.

The present invention is not limited to the concrete aspects of the processes disclosed in the above embodiments. For example, an operating parameter obtained (detected) by a certain sensor can be replaced by another operating parameter obtained (detected) by a different sensor, or an onboard estimated value using the another operating parameter. For example, in each of the steps shown in FIGS. 6 and 7, a load rate KL, the throttle valve opening TA, the acceleration operation amount PA, and the catalyst bed temperature may be used in place of the intake air flow rate Ga.

In place of the process of step 620 shown in FIG. 6, a determination as to whether or not a predetermine time has elapsed since a point in time at which the output Voxs of the downstream air-fuel ratio sensor 215*b* inverted from the lean side to the rich side may be made. The same is applicable for the process of the step 720 shown in FIG. 7. Further, an integration value of the intake air flow rate Ga after the inversion of the output may be used for the determination of the start of the spike.

The required air-fuel ratio $AF_{RS}$ for the rich spike may be set to a value which is the same as or richer than the required air-fuel ratio $AF_R$ for the rich request. Similarly, the required air-fuel ratio $AF_{LS}$ for the lean spike may be set to a value which is the same as or leaner than the required air-fuel ratio $AF_L$ for the lean request. That is, the ratios $AF_R$ and the $AF_{RS}$ may be set in a range from 13.5-14.5, and the ratios $AF_L$ and the $AF_{LS}$ may be set in a range from 14.7-15.7.

In the meantime, in a state in which the spikes are frequently introduced, the output of the upstream air-fuel ratio sensor 215*a* varies in accordance with a value obtained by "blurring" an actual fluctuation of the air-fuel ratio due to its responsivity. Accordingly, when a difference between the output Voxs of the downstream air-fuel ratio sensor 215*b* and the target value Voxs_ref is small, and thus, the spike interval (the rich spike interval $T_{RS}$ or the lean spike interval $T_{LS}$) is short, it is preferable that a main feedback learning for compensating a steady error of the output of the upstream air-fuel ratio sensor 215*a* is not carried out. That is, it is preferable that the main feedback learning be carried out when the output Voxs of the downstream air-fuel ratio sensor 215*b* deviates from the target value Voxs_ref by a predetermined value or larger, and thus, when the spike interval is long.

Figure 8:
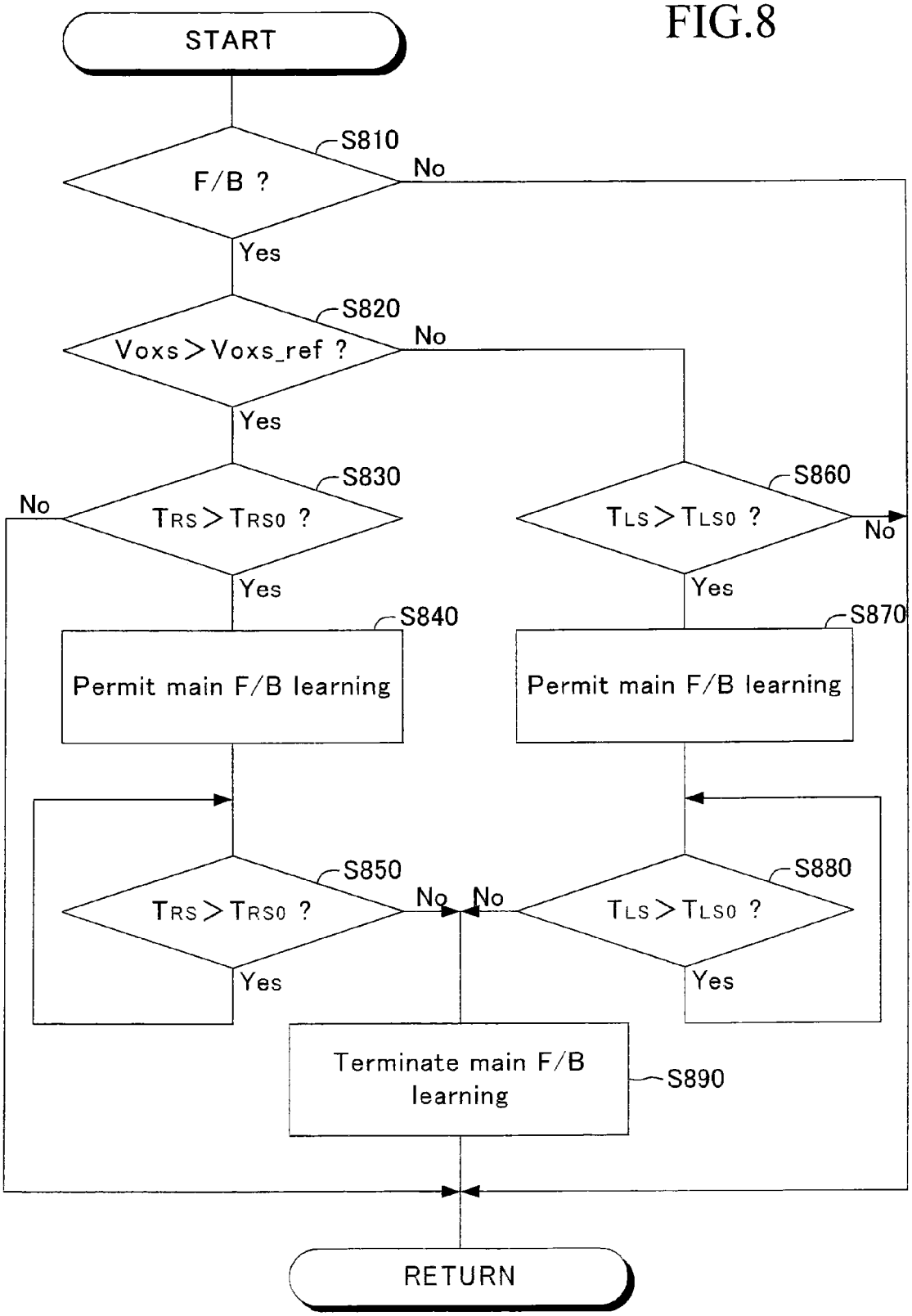
FIG. 8 is a flowchart showing another example of processes executed by the CPU shown in FIG. 1.

FIG. 8 is a flowchart showing an example of processes relating to an example of such an operation. Referring to FIG. 8, firstly, at step 810, it is determined whether or not the feedback control is being performed. When the feedback control is not being performed (step 810=No), all of following processes are skipped. When the feedback control is being performed (step 810=Yes), the process proceeds to step 820, at which it is determined whether or not the present output Voxs of the downstream air-fuel ratio sensor 215*b* is higher than the target value Voxs_ref corresponding to the stoichiometric air-fuel ratio.

When the present output Voxs of the downstream air-fuel ratio sensor 215*b* is higher than the target value Voxs_ref (step 820=Yes), the process proceeds to step 830 since the lean request is executed. At step 830, it is determined whether or not the rich spike interval $T_{RS}$ is longer than a predetermined value $T_{RS0}$ (note that, the rich spike interval $T_{RS}$ is set at a large value corresponding to an infinite value before the rich spike control is started.).

The determination at step 830 becomes "Yes", when the present point in time is before the rich spike control is executed or when the rich spike interval $T_{RS}$ is longer than the predetermined value $T_{RS0}$, and thus, the process proceeds to step 840 at which the main feedback learning is permitted. Thereafter, the process proceeds to step 850, at which it is again determined whether or not the rich spike interval $T_{RS}$ is longer than the predetermined value $T_{RS0}$. As long as the rich spike interval $T_{RS}$ is longer than the predetermined value $T_{RS0}$, the main feedback learning continues to be permitted (step 850=Yes).

On the other hand, when the rich request is executed (step 820=No), the process proceeds to step 860, at which it is determined whether or not the lean spike interval $T_{LS}$ is longer than a predetermined value $T_{LS0}$ (note that, similarly to the above case, the lean spike interval $T_{LS}$ is set at a large value corresponding to an infinite value before the lean spike control is started.).

The determination at step 860 becomes "Yes", when the present point in time is before the lean spike control is executed or when the lean spike interval $T_{LS}$ is longer than the predetermined value $T_{LS0}$, and thus, the process proceeds to step 870 at which the main feedback learning is permitted. Thereafter, the process proceeds to step 880, at which it is again determined whether or not the lean spike interval $T_{LS}$ is longer than the predetermined value $T_{LS0}$. As long as the lean spike interval $T_{LS}$ is longer than the predetermined value $T_{LS0}$, the main feedback learning continues to be permitted (step 880=Yes).

When the rich spike interval $T_{RS}$ is equal to or shorter than the predetermined value $T_{RS0}$ (step 850=No), or when the lean spike interval $T_{LS}$ is equal to or shorter than the predetermined value $T_{LS0}$ (step 880=No), the process proceeds to step 890 so that the main feedback learning is terminated. It should be noted that the processes of steps 840, 850, and 890 are skipped when the determination at step 830 is "No". Similarly, the processes of steps 870, 880, and 890 are skipped when the determination at step 860 is "No".

Figure 9:
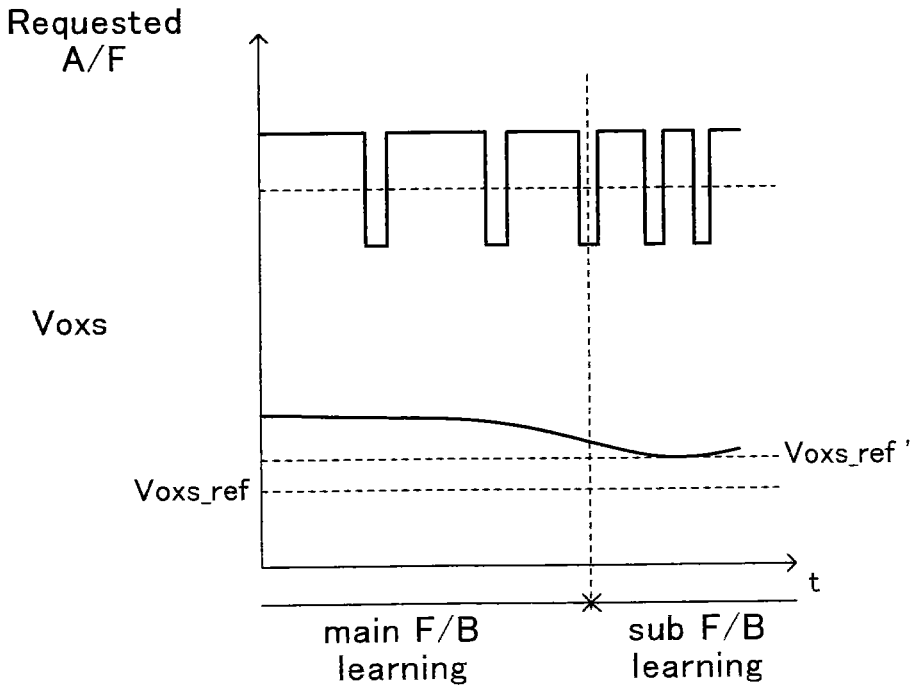
FIG. 9 is a timeline chart showing an aspect of another control performed by the present embodiment.

In this manner, in the present example, the main feedback control is permitted when the spike interval is longer than the predetermined value (refer to FIG. 9). Consequently, the accuracy degradation of the main feedback learning due to the effect of the spikes can be suppressed as much as possible.

In the meantime, a sub feedback learning for compensating a steady error of the output of the downstream air-fuel ratio sensor 215*b* can not be carried out, when the difference between the output Voxs of the downstream air-fuel ratio sensor 215*b* and the target value Voxs_ref is large. Accordingly, the sub feedback learning is carried out when the difference is small, and thus, when the spike interval (the rich spike interval $T_{RS}$ or the lean spike interval $T_{LS}$) is short. Specifically, as shown in FIG. 9, when the output Voxs of the downstream air-fuel ratio sensor 215*b* moves adversely (backwards), the target value (target voltage) is shifted from Voxs_ref to Voxs_ref' (local value when the output Voxs of the downstream air-fuel ratio sensor 215*b* moves adversely), so that the sub feedback learning is carried out.

Figure 10:
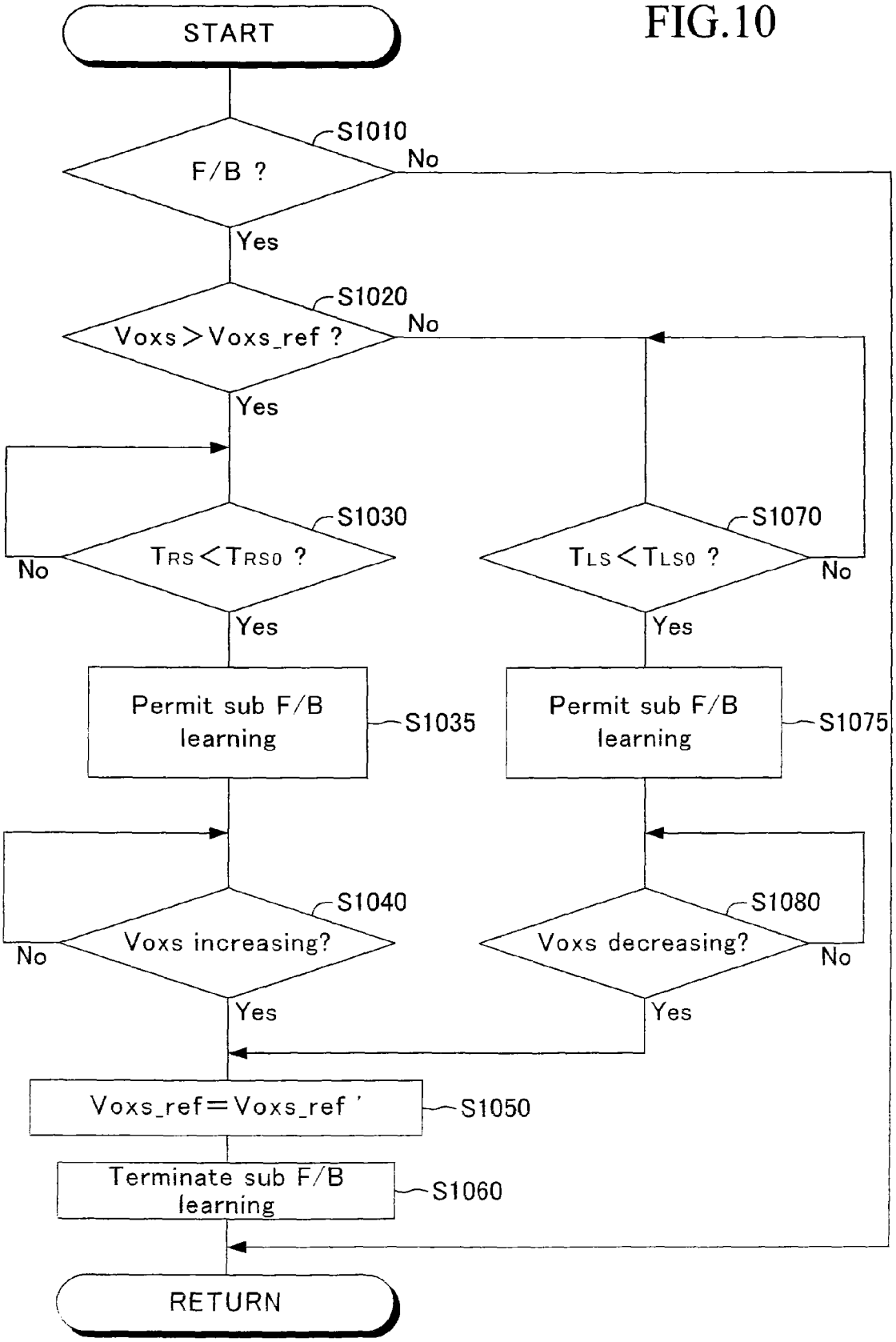
FIG. 10 is a flowchart showing an example of processes corresponding to the control shown in FIG. 9.

FIG. 10 is a flowchart showing an example of processes relating to an example of such an operation. Referring to FIG. 10, firstly, at step 1010, it is determined whether or not the feedback control is being performed. When the feedback control is not being performed (step 1010=No), all of following processes are skipped. When the feedback control is being performed (step 1010=Yes), the process proceeds to step 1020, at which it is determined whether or not the present output Voxs of the downstream air-fuel ratio sensor 215*b* is higher than the target value Voxs_ref corresponding to the stoichiometric air-fuel ratio.

When the present output Voxs of the downstream air-fuel ratio sensor 215*b* is higher than the target value Voxs_ref (step 1020=Yes), the process proceeds to step 1030 since the lean request is executed. At step 1030, it is determined whether or not the rich spike interval $T_{RS}$ is shorter than a predetermined value $T_{RS0}$. As long as the rich spike interval $T_{RS}$ is equal to or longer than the predetermined value $T_{RS0}$ (step 1030=No), the process does not proceed to step 1035 (that is, the sub feedback learning is not permitted).

When the rich spike interval $T_{RS}$ becomes shorter than the predetermined value $T_{RS0}$ (step 1030=Yes), the process proceeds to step 1035 at which the sub feedback learning is permitted. At step 1040, it is determined whether or not the output Voxs of the downstream air-fuel ratio sensor 215*b* moves adversely (that is, goes up) despite that the mean (averaged) air-fuel ratio is lean. When the output Voxs of the downstream air-fuel ratio sensor 215*b* moves adversely (step 1040=Yes), the process proceeds to step 1050 at which the target voltage is changed from Voxs_ref to Voxs_ref', and then, the sub feedback learning is terminated (step 1060).

On the other hand, when the rich request is executed (step 1020=No), the process proceeds to step 1070 at which it is determined whether or not the lean spike interval $T_{LS}$ is shorter than a predetermined value $T_{LS0}$. As long as the lean spike interval $T_{LS}$ is equal to or longer than the predetermined value $T_{LS0}$ (step 1070=No), the process does not proceed to step 1075 (that is, the sub feedback learning is not permitted).

When the lean spike interval $T_{LS}$ becomes shorter than the predetermined value $T_{LS0}$ (step 1070=Yes), the process proceeds to step 1075 at which the sub feedback learning is permitted. At step 1080, it is determined whether or not the output Voxs of the downstream air-fuel ratio sensor 215*b* moves adversely (that is, goes down) despite that the mean (averaged) air-fuel ratio is rich. When the output Voxs of the downstream air-fuel ratio sensor 215*b* moves adversely (step 1080=Yes), the process proceeds to step 1050 at which the target voltage is changed from Voxs_ref to Voxs_ref', and then, the sub feedback learning is terminated (step 1060), similarly to the above.

Needless to say, those modifications which are not particularly referred to are also encompassed in the scope of the present invention, so long as the invention is not modified in essence.

Those components which partially constitute means for solving the problems to be solved by the present invention and are illustrated with respect to operations and functions encompass not only the specific structures disclosed above in the description of the above embodiment and modifications but also any other structures that can implement the operations and functions. Further, the contents (including specifications and drawings) of the publications cited herein can be incorporated herein as appropriate by reference.

The invention claimed is:

1. An air-fuel ratio control apparatus applied to an internal combustion engine system which includes:

an internal combustion engine having cylinders in its inside;

an exhaust gas purifying catalyst disposed in an exhaust passage so as to purify an exhaust gas discharged from said cylinders;

a downstream air-fuel ratio sensor disposed in said exhaust passage and at a position downstream of said exhaust gas purifying catalyst in an exhaust gas flowing direction so as to generate an output corresponding to an air-fuel ratio of an exhaust gas at said position;

wherein said air-fuel ratio control apparatus performs an air-fuel ratio correction in such a manner that said air-fuel ratio control apparatus sets an air-fuel ratio of said internal combustion engine to an air-fuel ratio richer than a stoichiometric air-fuel ratio when it determines that a rich request is occurring based on a comparison between said output of said downstream air-fuel ratio sensor and a predetermined target value, and sets said air-fuel ratio of said internal combustion engine to an air-fuel ratio leaner than the stoichiometric air-fuel ratio when it determines that a lean request is occurring based on said comparison between said output of said downstream air-fuel ratio sensor and said predetermined target value, said air-fuel ratio control apparatus characterized by comprising:

an inverse direction spike introducing section configured so as to introduce a lean spike which temporarily changes said air-fuel ratio of said internal combustion engine to an air-fuel ratio leaner than the stoichiometric air-fuel ratio in a case where said air-fuel ratio of said internal combustion engine is set at said air-fuel ratio richer than the stoichiometric air-fuel ratio by said air-fuel ratio correction, and so as to introduce a rich spike which temporarily changes said air-fuel ratio of said internal combustion engine to an air-fuel ratio richer than the stoichiometric air-fuel ratio in a case where said air-fuel ratio of said internal combustion engine is set at said air-fuel ratio leaner than the stoichiometric air-fuel ratio by said air-fuel ratio correction;

an inverse direction spike interval setting section configured so as to set, based on an operating state of said internal combustion engine system, an interval between two of said lean spikes next to each other in time or of said rich spikes next to each other in time; and a downstream learning condition determining section configured so as to permit a learning for compensating a steady error of said output of said downstream air-fuel ratio sensor, wherein, said downstream learning condition determining section is configured so as to permit said learning based on said interval between two of said lean spikes next to each other in time or of said rich spikes next to each other in time.

2. The air-fuel ratio control apparatus according to claim 1 further comprising a deviation obtaining section configured so as to obtain a difference between said output of said downstream air-fuel ratio sensor and a predetermined target value, wherein, said inverse direction spike interval setting section is configured so as to set said interval between two of said lean spikes next to each other in time or of said rich spikes next to each other in time based on said difference.

3. The air-fuel ratio control apparatus according to claim 1, wherein, said inverse direction spike interval setting section is configured so as to set said interval between two of said lean spikes next to each other in time or of said rich spikes next to each other in time based on a load of said internal combustion engine.

4. The air-fuel ratio control apparatus according to claim 3, wherein, said inverse direction spike interval setting section is configured so as to set said interval between two of said lean spikes next to each other in time or of said rich spikes next to each other in time based on an intake air amount of said cylinder.

5. The air-fuel ratio control apparatus according to claim 1, wherein, said inverse direction spike interval setting section is configured so as to set said interval between two of said lean spikes next to each other in time or of said rich spikes next to each other in time based on a deterioration state of said exhaust gas purifying catalyst.

6. The air-fuel ratio control apparatus according to claim 1, further comprising an inverse direction spike time setting section configured so as to set an inverse direction spike time which is a duration time of said one lean spike or said one rich spike, based on said operating state of said internal combustion engine system.

7. The air-fuel ratio control apparatus according to claim 6, wherein, said inverse direction spike time setting section is configured so as to set said inverse direction spike time based on a load of said internal combustion engine.

8. The air-fuel ratio control apparatus according to claim 6, wherein, said inverse direction spike time setting section is configured so as to set said inverse direction spike time based on a deterioration state of said exhaust gas purifying catalyst.

9. The air-fuel ratio control apparatus according claim 1, further comprising an inverse direction spike strength setting section configured so as to set, based on an intake air amount of said cylinder, an inverse direction spike strength which is an air-fuel ratio change width in said one lean spike or said one rich spike.

10. The air-fuel ratio control apparatus according to claim 1, which is configured so as to perform said learning by correcting said target value at a point in time, at which a direction of a change in said output of said downstream air-fuel ratio sensor becomes a direction toward a lean air-fuel ratio while said lean spikes are being introduced, or at which said direction of said change in said output of said downstream air-fuel ratio sensor becomes a direction toward a rich air-fuel ratio while rich spikes are being introduced.

11. The air-fuel ratio control apparatus according to claim 1, further comprising an upstream learning condition determining section configured so as to permit a learning for compensating a steady error of an output of an upstream air-fuel ratio sensor which is disposed in said exhaust passage at a position upstream of said exhaust gas purifying catalyst and said downstream air-fuel ratio sensor in said exhaust gas flowing direction in said internal combustion engine system so as to generate said output corresponding to an air-fuel ratio of said exhaust gas at said position, wherein, said upstream learning condition determining section is configured so as to permit said learning based on said interval between two of said lean spikes next to each other in time or of said rich spikes next to each other in time.

12. The air-fuel ratio control apparatus according to claim 2, wherein, said inverse direction spike interval setting section is configured so as to set said interval between two of said lean spikes next to each other in time or of said rich spikes next to each other in time based on a load of said internal combustion engine.

13. The air-fuel ratio control apparatus according to claim 12, wherein, said inverse direction spike interval setting section is configured so as to set said interval between two of said lean spikes next to each other in time or of said rich spikes next to each other in time based on an intake air amount of said cylinder.

14. The air-fuel ratio control apparatus according to claim 2, wherein, said inverse direction spike interval setting section is configured so as to set said interval between two of said lean spikes next to each other in time or of said rich spikes next to each other in time based on a deterioration state of said exhaust gas purifying catalyst.

15. The air-fuel ratio control apparatus according to claim 2, further comprising an inverse direction spike time setting section configured so as to set an inverse direction spike time which is a duration time of said one lean spike or said one rich spike, based on said operating state of said internal combustion engine system.

16. The air-fuel ratio control apparatus according claim 2, further comprising an inverse direction spike strength setting section configured so as to set, based on an intake air amount of said cylinder, an inverse direction spike strength which is an air-fuel ratio change width in said one lean spike or said one rich spike.

17. The air-fuel ratio control apparatus according to claim 2, which is configured so as to perform said learning by correcting said target value at a point in time, at which a direction of a change in said output of said downstream air-fuel ratio sensor becomes a direction toward a lean air-fuel ratio while said lean spikes are being introduced, or at which said direction of said change in said output of said downstream air-fuel ratio sensor becomes a direction toward a rich air-fuel ratio while rich spikes are being introduced.

18. The air-fuel ratio control apparatus according to claim 2, further comprising an upstream learning condition determining section configured so as to permit a learning for compensating a steady error of an output of an upstream air-fuel ratio sensor which is disposed in said exhaust passage at a position upstream of said exhaust gas purifying catalyst and said downstream air-fuel ratio sensor in said exhaust gas flowing direction in said internal combustion engine system so as to generate said output corresponding to an air-fuel ratio of said exhaust gas at said position, wherein, said upstream learning condition determining section is configured so as to permit said learning based on said interval between two of said lean spikes next to each other in time or of said rich spikes next to each other in time.

* * * * *